United States Patent [19]

Nakazawa et al.

[11] Patent Number: 4,699,595

[45] Date of Patent: Oct. 13, 1987

[54] ELECTRICAL CONNECTOR RECEPTACLE AND PROCESS FOR MANUFACTURING SAME

[75] Inventors: Akira Nakazawa; Tooru Watanabe, both of Tokyo, Japan

[73] Assignee: Hirose Electric Co., Tokyo, Japan

[21] Appl. No.: 839,341

[22] Filed: Mar. 13, 1986

[30] Foreign Application Priority Data

Oct. 11, 1985 [JP] Japan ..... 60-226535

[51] Int. Cl.[4] ..... H01R 13/506

[52] U.S. Cl. ..... 439/676; 439/701; 29/876

[58] Field of Search ..... 339/206, 207, 209, 210, 339/91 R; 29/876; 439/347, 676, 701, 707, 736, 752, 569

[56] References Cited

U.S. PATENT DOCUMENTS

| | | | |
|---|---|---|---|
| 4,063,790 | 12/1977 | Kleykamp et al. | 339/91 R |
| 4,193,654 | 3/1980 | Hughes et al. | 339/17 LC |
| 4,202,593 | 5/1980 | Abernethy et al. | 339/176 M |
| 4,210,376 | 7/1980 | Hughes et al. | 339/17 LC |
| 4,274,691 | 6/1981 | Abernethy et al. | 339/206 R |
| 4,458,973 | 7/1984 | Hayes et al. | 339/91 R |
| 4,618,207 | 10/1986 | Silbernagel | 339/206 R |
| 4,632,493 | 12/1986 | Matsuzaki et al. | 439/676 |

*Primary Examiner*—Gil Weidenfeld
*Assistant Examiner*—Daniel W. Howell
*Attorney, Agent, or Firm*—Yusuke Takeuchi

[57] ABSTRACT

An electrical connector receptacle, which comprises an insulating housing; a plurality of parallel contacts arranged in said insulating housing; a plurality of parallel recesses provided in the inside of the housing top wall adjacent to the plug-receiving end for receiving the bent portions of contacts between the intermediate portions and the spring portions; a block-receiving opening provided in the housing rear portion; and a contact support block adapted to fit into the block-receiving opening. A process for manufacturing an electrical connector receptor, which comprises preparing an insulating housing and a plurality of contacts each having a fixing portion, an intermediate portion extending from the fixing portion at right angles, and a spring portion diagonally extending in the plug-receiving opening toward the housing rear end; preparing a contact support block; inserting the contact fixing portions through the contact block; and fitting the contact support block into the block-receiving opening so that each bent portion of the contact between the intermediate portion and the spring portion rests in the corresponding parallel recess.

9 Claims, 16 Drawing Figures

ELECTRICAL CONNECTOR RECEPTACLE AND PROCESS FOR MANUFACTURING SAME

BACKGROUND OF THE INVENTION

1. Field of the Invention

The present invention relates to electrical connector receptacles, more particularly to an electrical connector receptacle suitable for a modular connector for telephone sets or measuring instruments, and a process for manufacturing the same.

2. Description of the Prior Art

In recent years, a growing number of small and inexpensive modular connectors are used for telephone sets, measuring instruments, or minicomputers. For example, Japanese Patent Kokai No. 55-37,800 discloses a modular connector of such a type. As FIGS. 15 and 16 show, this modular connector consists of a connector receptacle 10 and a connector plug 20. An insulating housing 11 of receptacle 10 is made of plastic and has a post 13 for mounting on a circuit board 30. The insulating housing 11 has a plug-receiving end 11A, a rear end 11B, and a plug-receiving opening 12 extending from the plug-receiving end toward the rear end. The plug-receiving opening 12 is defined by upper and lower internal walls 12A and 12B and opposite internal side walls 12C. The insulating housing has upper and lower external walls 13A and 13B and opposite external side walls 13C. The lower external wall is provided integrally with a post 13 for mounting the connector receptacle 13 on the circuit board 30 by inserting the post into a hole of the circuit board. A plurality of parallel recesses 14 are provided between upper internal and external walls 12B and 13B and communicate with a plurality of parallel channels 15 provided on upper external wall 13B. A plurality of parallel barriers 15A are provided between channels 15 and extend beyond rear end 11B and downward to lower external wall 13A. A pair of retainer surfaces 16 are provided in plug-receiving opening 12. A plurality of parallel contacts 17 are arranged within housing 11. Each contact has an elongated intermediate portion 17A extending across upper external wall 13B and bent downward at 17B. The intermediate portion 17A has a tail portion 17C extending downward across rearward end 11B. The spring portion 17D of each contact 17 extends diagonally from the bent portion 17B within the recess 14 toward the plug-receiving opening 12. The free end of tail 17C of each contact 17 protrudes from lower external wall 13A for soldering to the conductor of circuit board 30. A central recess 18 is provided at the center of lower internal wall 12A extending downward to plug-receiving end 11A. A pair of opposite shoulders are provided on both sides of central recess 18 giving retainer surfaces 16. These shoulders face toward the rear end 11B of housing 11 for engagement with the shoulders of a latch arm 21. As best shown in FIG. 16, when the plug 20 is inserted into the plug-receiving opening 12 of connector receptacle 10 mounted on the circuit board 30 until the shoulder of latch arm 21 engages the shoulders of the retainer 16, the spring portions 17D of individual contacts 17 come into electrical contact with the corresponding terminals 22 of plug 20.

U.S. Pat. No. 4,193,654 issued to Hughes et al. on Mar. 18, 1980, discloses substantially the same electrical connector receptacles as described above.

U.S. Pat. No. 4,202,593 issued to Abernethy et al. on May 13, 1980, discloses a telephone jack comprising a cover portion and a base portion. The base portion has a rectangular pillar with a plurality of vertically extending cavities and an integral platform with a clearance separating the platform and the bottom wall. The platform has a plurality of parallel grooves. Each elongated contact is inserted into the cavity through the bottom. Then, the contact is bent laterally at a first bend to follow along a corresponding groove of the platform. The contact is bent again at a second arcuate bend to follow along the groove in the arcuate end. A free end of each contact projects diagonally from the end into the clearance.

U.S. Pat. No. 4,210,376 issued to Huges et al. on Jul. 1, 1980, discloses an electrical connector receptacle comprises a one piece molded housing having a plug-receiving end, a plug-receiving opening extending toward the plug-receiving end, and a plurality of parallel channels in the upper external wall. A plurality of parallel contacts are mounted in the housing by positioning a section of the strip bent at right angles in the channel, with free ends adjacent to the shoulder, bending the spring portions inwardly into the plug-receiving opening, and bending the other end portions downward into the rear end channels.

However, these electrical connector receptacles have some of the following shortcomings:

The contacts extend upward across the rear wall and laterally along the upper external wall and bent inward below the upper internal wall thus surrounding the upper wall. Consequently, it is very hard to mount prefabricated contacts within the insulating housing. For this reason, the contacts must be bent into a desired shape after they are placed on the insulating housing. This is a very difficult operation without bending the soft plastic housing. Thus, such operation has been troublesome and time consuming, pushing up the connector price. In addition, the intermediate portion of each contact in the channel is exposed to the outside so that dirt and dust tend to accumulate on the contacts, causing troubles such as a short-circuit.

SUMMARY OF THE INVENTION

Accordingly, it is an object of the present invention to provide an electrical connector receptacle free of such problems as described above.

It is another object of the invention to provide a process for manufacturing the same.

According to the present inventions there is provided an electrical connector receptacle having an insulating housing with a plug-receiving end, an opposite rear end, a plug receiving opening extending toward the plug-receiving end, and top, bottom, and side walls defining the plug-receiving opening; a plurality of parallel contacts arranged in the insulating housing, each contact having a spring portion diagonally extending in the plug-receiving opening from the top wall in the vicinity of the plug-receiving end toward the rear end, and intermediate portion laterally extending along the top wall from the plug-receiving end toward the rear end, and a fixing portion substantially perpendicularly extending downward in the vicinity of the rear end from the top wall through the bottom wall; and the plug-receiving opening adapted to receive a connector plug having a plurality of terminals for engaging the spring portions; characterized by a plurality of parallel recesses provided in the inside of the top wall in the vicinity of the plug-receiving end for receiving the bent portions of the contacts between the intermediate portions and the spring portions; a block-receiving opening provided in the rear portion of the insulating housing; a contact support block adapted to fit into the block-receiving opening and having a top face facing toward the top wall and a bottom face facing toward the bottom wall, and a plurality of through holes extending from the top face to the bottom face for receiving the contact fixing portions so that the intermediate portions extend along the top face toward the plug-receiving end and that the bent portions rest in the parallel recesses when the contact block is inserted into the block-receiving opening from the housing rear end.

There is also provided a process for manufacturing an electrical connector receptor, characterized by the steps of preparing an insulating housing having a plug-receiving end, an opposite rear end, a plug-receiving opening extending toward the plug-receiving end, and top, bottom, and side walls defining the plug-receiving opening, and a plurality of parallel recesses in the inside of the top wall in the vicinity of the plug-receiving end, and a block-receiving opening extending toward the rear end; preparing a plurality of contacts each having a fixing portion, an intermediate portion extending from the upper end of the fixing portion at substantially right angles toward the plug-receiving end, and a spring portion diagonally extending in the plug-receiving opening from the front end of the intermediate portion toward the housing rear end; preparing a contact support block adapted to fit into the block-receiving opening and having a top face facing the housing top wall and a bottom face facing toward the housing bottom wall; arranging the contacts so that the contact fixing portions pass through the contact block from the top face through the bottom face and that the intermediate portions extend along the top wall toward the plug-receiving end; and fitting the contact support block into the block-receiving opening so that each bent portion between the intermediate portion and the spring portion rests in the corresponding parallel recess.

Other and further objects, features and advantages of the invention will appear more fully from the following description.

Figure 2:
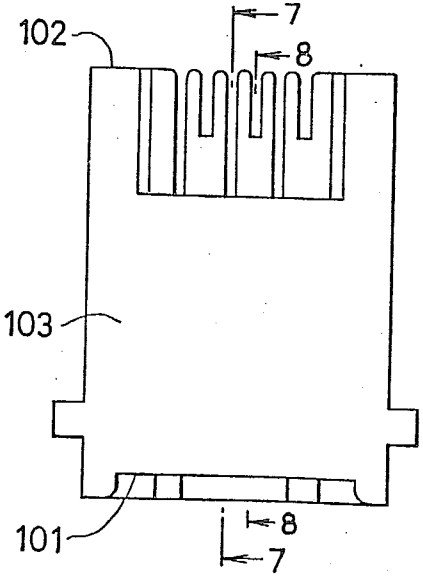
FIG. 2 is a top view of the insulating housing of FIG. 1.

FGI. 8 is a sectional view of the receptacle taken along the line 8—8 of FIG. 2 showing the contact and the contact block.

Figure 1:
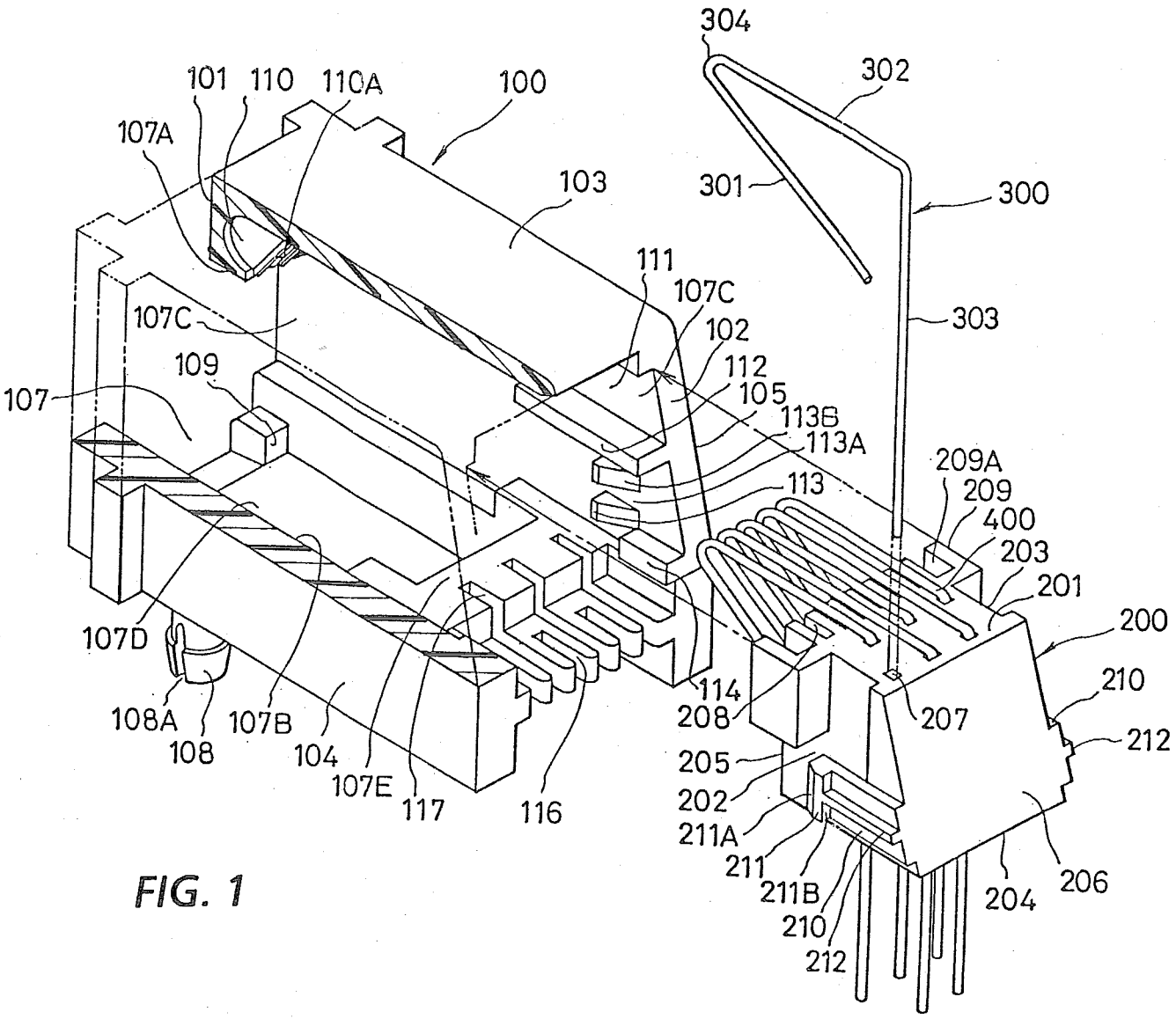
FIG. 1 is a perspective exploded view of an electrical connector receptacle embodying the present invention.
Figure 4:
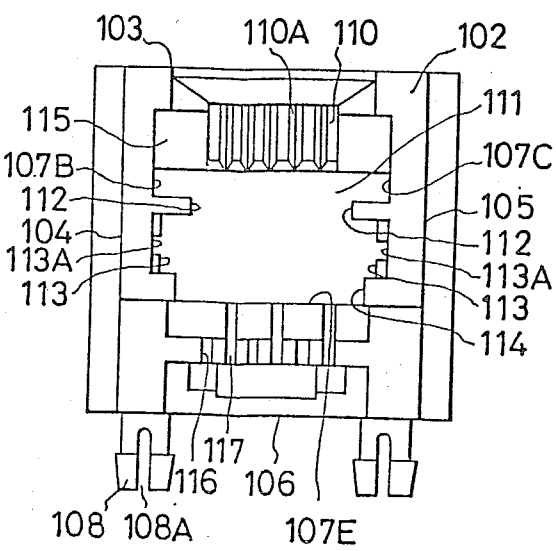
FIG. 4 is a rear view of the housing.
Figure 5:
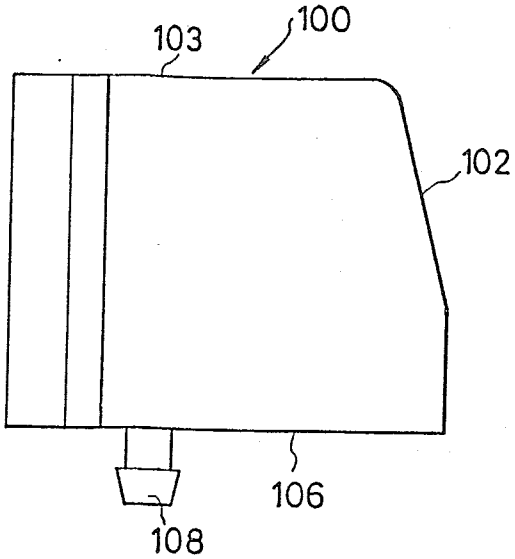
FIG. 5 is a right side view of the housing.
Figure 3:
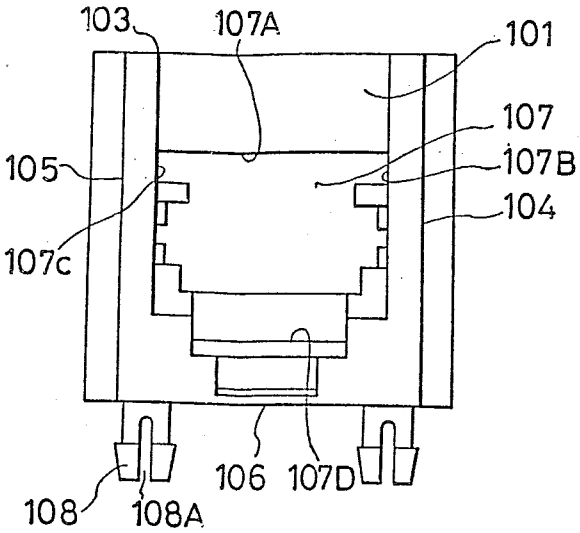
FIG. 3 is a front view of the housing.
Figure 6:
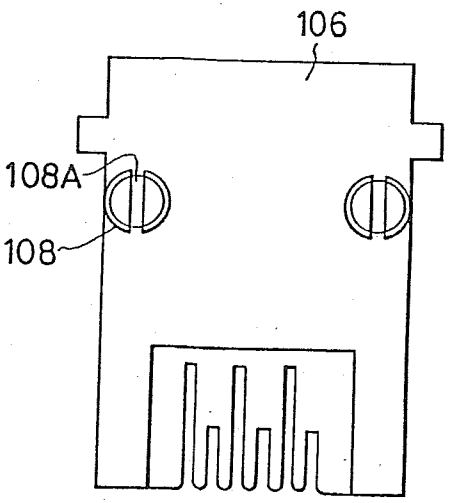
FIG. 6 is a bottom view of the housing.
Figure 9:
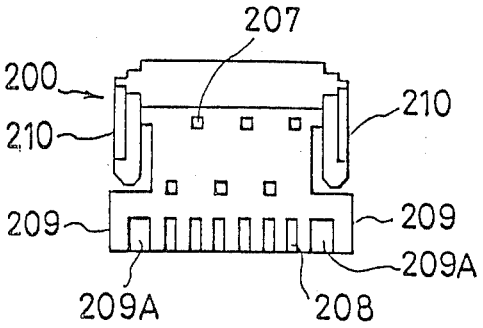

FIG. 9 is a top view of the block of FIG. 1.

Figure 10:
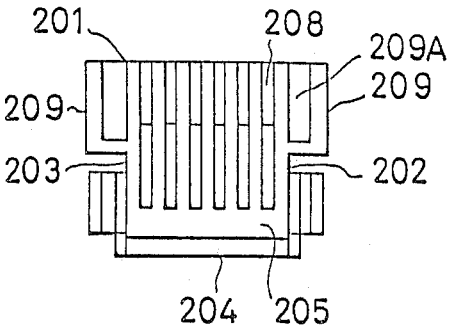

FIG. 10 is a front view of the block.

Figure 11:
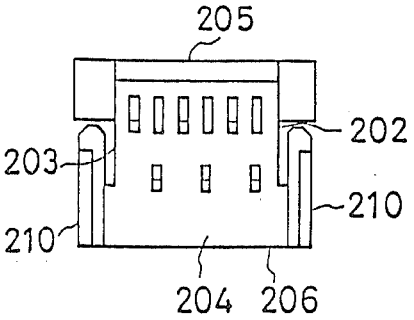

FIG. 11 is a bottom view of the block.

Figure 12:
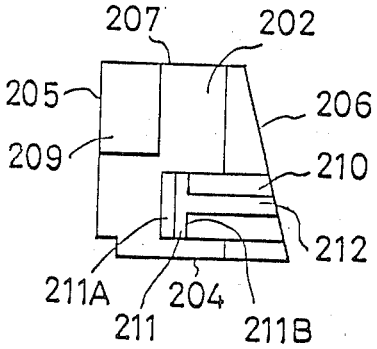

FIG. 12 is a right side view of the block.

Figure 13:
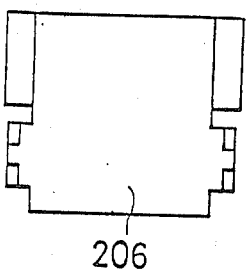

FIG. 13 is a rear view of the block.

Figure 14:
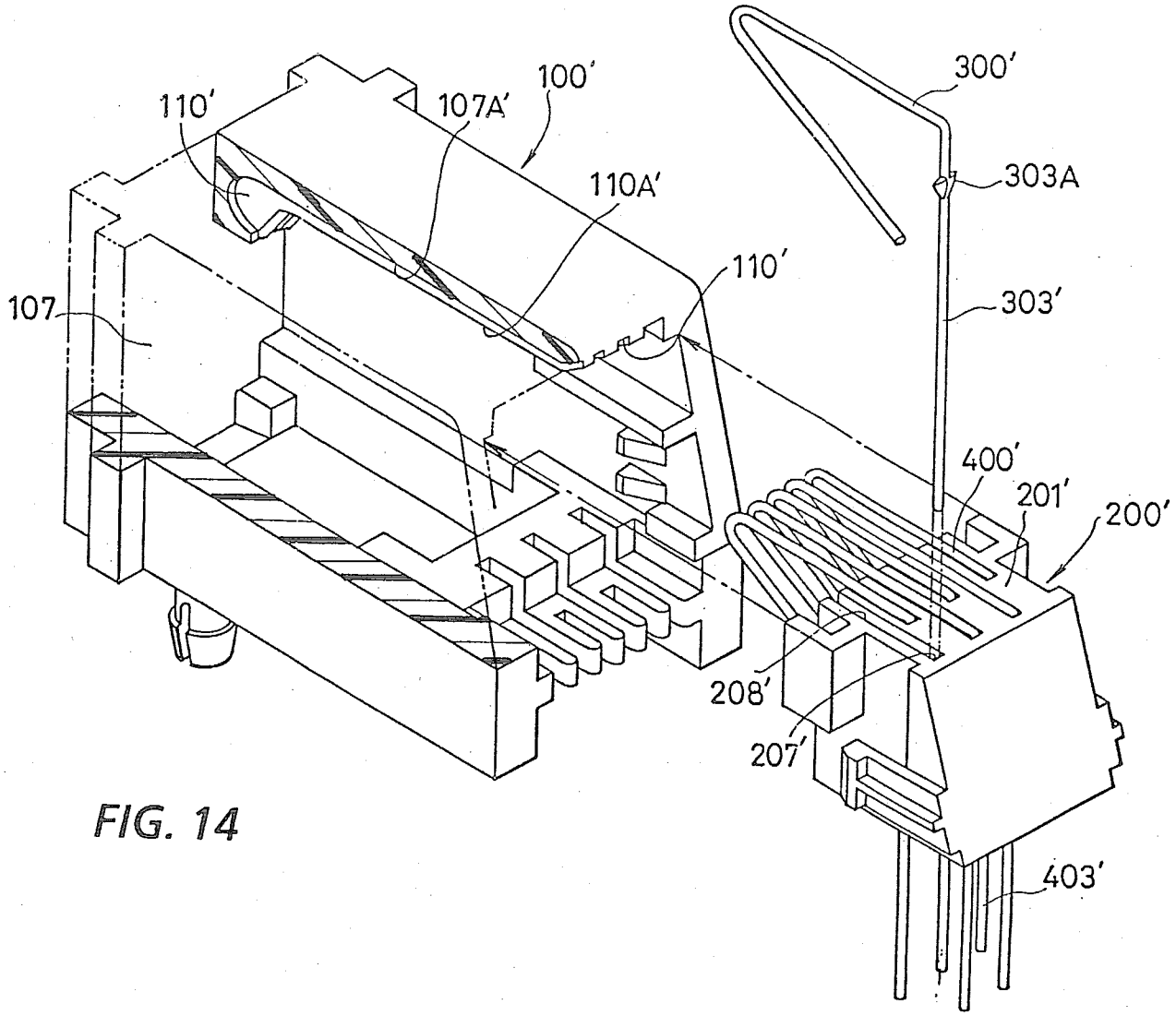

FIG. 14 is a perspective exploded view of another embodiment of the electrical connector receptor of the invention.

Figure 15:
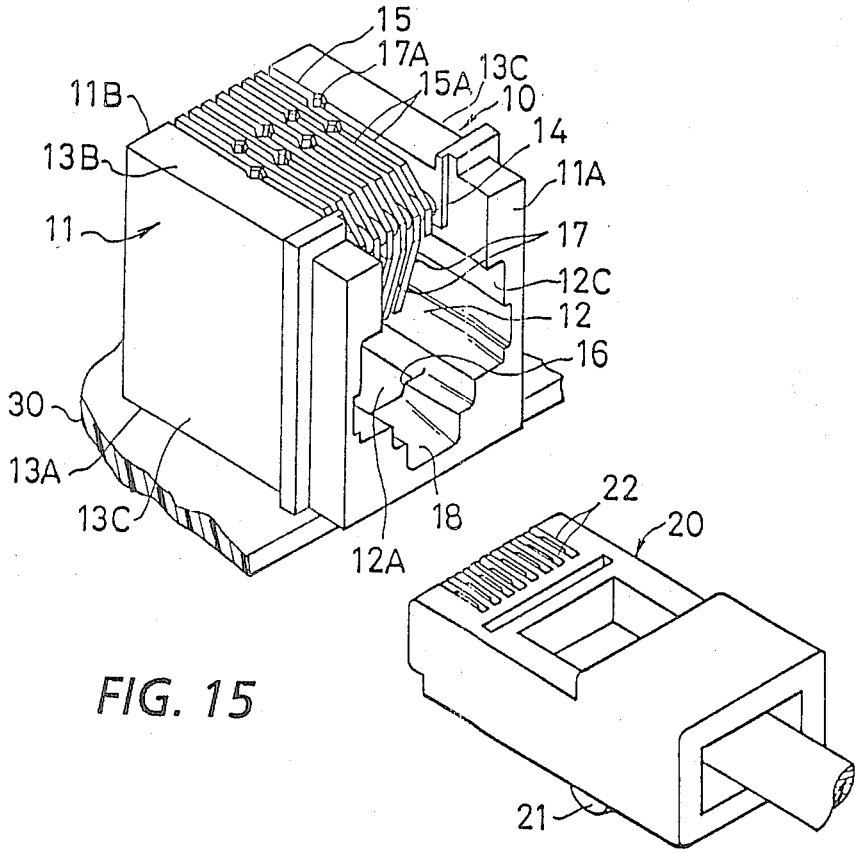

FIG. 15 is a persective exploded view of a modular connector of the prior art.

Figure 16:
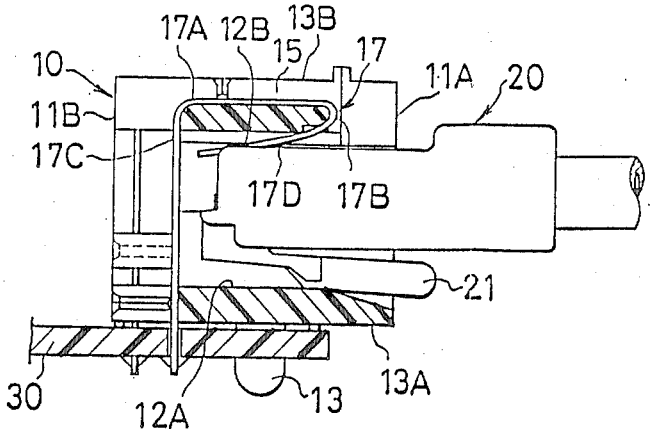

FIG. 16 is a sectional view of the modular connector in which the plug is inserted into the receptacle.

DESCRIPTION OF THE PREFERRED EMBODIMENTS

Referring now to the accompanying drawings, and more particularly to FIG. 1, there is shown an electrical connector receptacle which comprises an insulating housing 100 made of a material, such as a plastic, a contact support block 200 adapted to be inserted into the insulating housing from the back, and a plurality of parallel contacts 300 and 400 supported by the block and arranged within the housing.

The insulating housing 100 has a plug-receiving end 101, a rear end 102, an upper wall 103, a right side wall 104, a left side wall 105, and a lower wall 106 and a plug-receiving opening 107 that extends toward the plug-receiving end. The lower wall 106 has a pair of integral mounting posts 108 that each have a slot 108A for easy engagement with the mounting hole of a circuit board.

The plug-receiving opening 107 is defined by an upper inside wall 107A, a right inside wall 107B, a left inside wall 107C, and a lower inside wall 107D and has the shape and size adapted to receive the conventional plug 20 as shown in FIGS. 15 and 16. Like the conventional connector receptacle 10, a pair of retainer surfaces 109 are provided on both sides of the front end of lower inside wall 107D so as to engage the shoulders of a latch arm 21 of the plug.

A plurality of, six in this case, parallel recesses 110 are provided in the upper inside wall 107A near the plug-receiving end 101 to receive individual contact spring portions 301 and 401 and bent portions 304 and 404 between the spring portions and intermediate portions 302 and 402 when the contact assembly block is inserted from the rear end of the housing. These parallel recesses are separated from each other with parallel barriers 110A.

A block receiving opening 111 is provided toward the rear end of housing 100 to receive the contact support block 200. A pair of rails 112 are provided on the right and left inside walls 107B and 107C to guide insertion of the contact support block 200. A pair of latch projections 113 each having a pair of slanting surfaces 113B with a space 113A between them are provided on each inside wall below the guide rail 112. A pair of support projections 114 are provided below the latch projections 113 to slidably engage a pair of lower cuts of block 200. A stopper 115 is provided at the end of block receiving opening 111 to abut against abutting projection 209 of the block 200 to stop the further insertion of block 200.

A rear lower web 107E is provided at the rear end 102 of housing 100 and has six parallel fixing recesses 116 and 117 at its rear to receive the fixing portions 303 and 403 of contacts 300 and 400.

As best shown in FIGS. 1 and 9 through 13, the contact block 200 has a substantially cubic form defined by six faces; a top 201, a right side 202, a left side 203, a bottom 204, a front 205, and a rear 206. A plurality of square through holes 207 extending from the top 201 to the bottom 204 are arranged in staggered fashion. A plurality of parallel support recesses 208 are provided in the upper front 205 to receive and support the free ends of contact spring portions 301 and 401.

The abutting projections 209 each having a recess 209A on the abutting face are provided on the upper front portions of right and left sides 202 and 203. A pair of latch tongues 210 extend from the rear toward the front on the lower portions of both sides 202 and 203. A latch projection 211 having a slanting surface 211A and a latching surface 211B is provided on the front portion of each latch tongue 210. A rim 212 extends from the latch projection 211 toward the rear for reinforcement of the latch tongue 210. The rear 206 of block 200 is inclined at the same angle as the rear 102 of housing 100.

Figure 7:
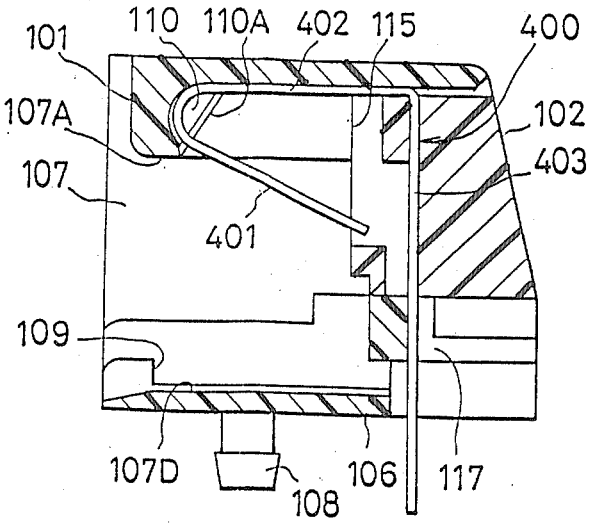
FIG. 7 is a sectional view of the receptacle taken along the line 7—7 of FIG. 2 showing the contact and the contact block.
Figure 8:
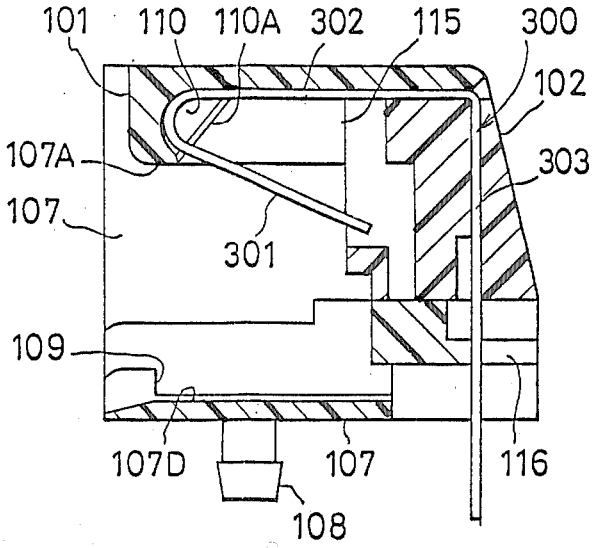

There are two slightly different kinds of contacts arranged on the contact block 200. As best shown in FIG. 8, one kind of contacts 300 each have the spring portion 301 diagonally extending into the plug-receiving opening from the upper front portion toward lower rear portion of housing 100, an intermediate portion 302 laterally extending along the inside of top wall 103 from the plug-receiving end toward the rear end 102, and a fixing portion 303 vertically extending from the upper wall 103 toward the lower wall 106 in the vicinity of the rear 102. As best shown in FIG. 7, like the contracts 300, another kind of contacts 400 each have a spring portion 401, an intermediate portion 402, and a fixing portion 403 only except that the bending point between the intermediate portion 402 and the fixing portion 403 is farther from the rear end 102 than that of contact 300.

A process for producing an electrical connector receptacle according to the invention will be described below.

(1) First, contracts 300 and 400 as shown in FIGS. 7 and 8 are prepared, and their fixing portions 303 and 403 are inserted into the staggered through holes 207 of contact block 200 as shown in FIG. 1 in such a manner that the contacts 300 and 400 are inserted into the through holes 207 near the rear end 206 and the front end 205, respectively.

(2) The contact mounted block 200 is then inserted into the block-receiving opening 111 provided in the rear portion of insulating housing 100. The guide rails 112 ensure the smooth and stable insertion of the block 200, and each of the bent portion 304 and 404 fits into the corresponding spaced recess 110. At the same time, the slanting surfaces 211A of latch tongues 210 comes into contact with the slanting surfaces 113B of latch projections 113 so that the front portions of latch tongues 210 are bent toward the block sides and then return to its original position to engage the latch projections 113 of housing 100. At this point, the stoppers 115 of housing 100 abut against the abutting projections 209 of block 200 to stop further advancement of the block. This concludes the assembly as shown in FIGS. 7 and 8.

In the above embodiment, since the fixing portions 303 and 403 of contacts 300 and 400 are merely inserted into the through holes 207 of block 200, they can come off from the holes 207. In order to prevent such separation, an adhesive may be put into the holes 207 before insertion of the contacts or the contacts may be arranged in the metal mold and then molded integrally with the block 200.

In FIG. 14 there is shown another embodiment of the invention, in which a plurality of parallel elongated barriers 110A' similar to the parallel barriers 110A of the above first embodiment are provided on the top inside wall 107' of housing 100'. These elongated barriers prevent swinging motion of the contacts at the time of assembly. The other structure is substantially the same as that of the first embodiment and its description is omitted.

In addition, the fixing portion 303' or 403' of each contact 300' or 400' may be provided with a reversed substantially triangular projection 303A to prevent the contacts from coming off from the through hole 207' of block 200, thus making the assembly very easy. The other structure is substantially the same as that of the first embodiment and its description is omitted.

Alternatively, the elongated barriers 110A' provided on the top inside wall of insulating housing 100' in FIG. 14 may be eliminated by providing a plurality of parallel channels 208' on top of the block 200' for embeding the intermediate portions of contacts 300' and 400'.

According to the present invention, individual contacts may be bent into a predetermined form and then assembled into a contact block. This contact block is easy to insert into an insulating housing to make a connector receptacle, thus eliminating a troublesome bending operation on the soft housing. The above more finely divided operations are easier to carry out on an assembly line, thus increasing the productivity and reducing the connector manufacturing cost. The intermediate and fixing portions of each contact of the invention are covered completely by the top wall of housing and the contact support block, thus eliminating the possibility of collecting dirt or dust which can cause a short-circuit or other accidents.

Although preferred embodiments of the present invention are described above, other embodiments and modifications which would be apparent to one having ordinary skill in the art are intended to be covered by the spirit and scope of the appended claims:

What is claimed is:

1. An electrical connector receptacle, which comprises:

an insulating housing with a plug-receiving end, an opposite rear end, a plug-receiving opening extending toward the plug receiving end, and top, bottom, and side walls defining said plug-receiving opening;

a plurality of parallel contacts arranged in said insulating housing, each contact having a spring portion diagonally extending in said plug-receiving opening from said top wall in the vicinity of said plug-receiving end toward said rear end, an intermediate portion laterally extending along said top wall from said plug-receiving end toward said rear end, and a fixing portion substantially perpendicularly extending downward in the vicinity of said rear end from said top wall through said bottom wall; and said plug receiving opening adapted to receive a connector plug having a plurality of terminals for engaging said spring portions:

a plurality of parallel recesses provided in the inside of said top wall in the vicinity of said plug-receiving end for receiving the bent portions of said contacts between said intermediate portions and said spring portions;

a block-receiving opening provided in the rear portion of said insulating housing;

a contact support block adapted to fit into said block receiving opening and having a top face facing toward said top wall and a bottom face facing toward said bottom wall, and a plurality of through holes extending from said top face to said bottom face for receiving said contact fixing portions so that said intermediate portions extend along said top face toward the plug-receiving end and that said bent portions rest in said parallel recesses when said contact block is inserted into said block receiving opening from said housing rear end; and said contact support block has a plurality of parallel recesses on the side facing toward said plug-receiving end for supporting the free ends of said contact spring portions.

2. An electrical connector receptacle as recited in claim 1, wherein said insulating housing has a pair of latch projections on said side walls and said contact support block has a pair of latch tongues on both sides facing toward said housing side walls for engaging said latch projections so that said contact support block is locked into said insulating housing.

3. An electrical connector receptacle as recited in claim 1, wherein said parallel recesses extend along said top wall up to the vicinity of said rear end to form parallel channels for receiving said contact intermediate portions.

4. An electrical connector receptacle as recited in claim 1, wherein said contact block has a plurality of parallel channels on said top face for embedding parts of said contact intermediate portions.

5. A process for manufacturing an electrical connector receptable, which comprises the steps of:

preparing an insulating housing having a plug-receiving end, an opposite rear end, a plug-receiving opening extending toward said plug-receiving end, and top, bottom, and side walls defining said plug-receiving opening, and a plurality of parallel recesses in the inside of said top wall in the vicinity of said plug-receiving end, and a block-receiving opening extending toward said rear end;

preparing a plurality of contacts each having a fixing portion, an intermediate portion extending from the upper end of said fixing portion at substantially right angles toward said plug-receiving end, and a spring portion diagonally extending in said plug-receiving opening from the front end of said intermediate portion toward said housing rear end;

preparing a contact-support block adapted to fit into said block receiving opening and having a top face facing said housing top wall and a bottom face facing toward said housing bottom wall;

arranging said contacts so that said contact fixing portions pass through said contact block from said top face through said bottom face, the free ends of said spring portions rest in recesses of said contact support block, and that said intermediate portions extend along said top wall toward the plug-receiving end; and fitting said contact support block into said block receiving opening so that each bend portion of said contact between said intermediate portion and said spring portion rests in said corresponding parallel recess.

6. A process for manufacturing an electrical connector receptacle as recited in claim 5, which further comprises:

forming a plurality of through holes in said contact support block extending from said top face to said bottom face;

inserting said contact fixing portions into said through holes; and filling said through holes with an adhesive so that said contacts are secured to said contact block.

7. A process for manufacturing an electrical connector receptacle as recited in claim 5, which further comprises:

forming a plurality of through holes in said contact support block extending from said top face to said bottom face;

filling said through holes with an adhesive; and inserting said contact fixing portions into said through holes so that they are secured to said contact block with said adhesive.

8. A process for manufacturing an electrical connector receptacle as recited in claim 5, wherein said contact fixing portions are secured to said contact block by molding integrally with said contact block.

9. A process for manufacturing an electrical connector receptacle as recited in claim 5, which further comprises:

forming a plurality of through holes in said contact support block from said top face to said bottom face; and forming a separation preventive projection on each of said contact fixing portions so that when said fixing portionds are inserted into said holes, said contacts are secured to said contact support block.

* * * * *